United States Patent [19]

Martin

[11] Patent Number: 5,064,179

[45] Date of Patent: Nov. 12, 1991

[54] METHOD OF FORMING ZIGZAG-SHAPED PILES FROM A CONTINUOUS BAND OF A FLEXIBLE MATERIAL AND MACHINE FOR CARRYING OUT THIS METHOD

[75] Inventor: Martial G. Martin, Villejuif, France

[73] Assignee: Syntone, Bruxelles, Belgium

[21] Appl. No.: 673,169

[22] Filed: Apr. 11, 1991

Related U.S. Application Data

[63] Continuation of Ser. No. 282,266, Dec. 9, 1988, abandoned.

[30] Foreign Application Priority Data

Dec. 10, 1987 [FR] France ..... 87 17241

[51] Int. Cl.[5] ..... B41L 1/32

[52] U.S. Cl. ..... 270/39; 270/52.5; 270/211; 493/353; 493/357; 493/414; 225/100

[58] Field of Search ..... 270/21.1, 31, 32, 39, 270/40, 41, 51, 52, 52.5; 493/353, 356–360, 410, 411, 412, 413, 414; 225/100, 101, 106

[56] References Cited

U.S. PATENT DOCUMENTS

| | | | |
|---|---|---|---|
| 4,504,051 | 3/1985 | Bittner | 270/40 |
| 4,512,561 | 4/1985 | Ury | 270/40 |
| 4,533,130 | 8/1985 | Suter | 270/41 |
| 4,673,382 | 6/1987 | Buck | 270/39 |
| 4,688,708 | 8/1987 | Irvine | 493/410 |
| 4,702,135 | 10/1987 | Kwasnitza | 493/357 |
| 4,778,165 | 10/1988 | Buck | 270/39 |

FOREIGN PATENT DOCUMENTS

| | | |
|---|---|---|
| 0057463 | 8/1982 | European Pat. Off. . |
| 0159717 | 10/1985 | European Pat. Off. . |
| 0187344 | 7/1986 | European Pat. Off. . |
| 0228758 | 7/1987 | European Pat. Off. . |
| 1550885 | 12/1968 | France . |
| 2331502 | 6/1977 | France . |
| 1031934 | 6/1966 | United Kingdom . |

*Primary Examiner*—Edward K. Look
*Assistant Examiner*—Therese M. Newholm
*Attorney, Agent, or Firm*—Kenyon & Kenyon

[57] ABSTRACT

The invention relates to a method and a machine for forming zigzag-shaped piles from an endless band of paper wherein the band is deposited and folded on an appropriate support and, at the end of the formation of a pile, a rupture of the band is provoked along a predetermined folding line, the first folding flap of the following pile to be formed is brought into a predetermined position, the forward movement of the band is stopped and the pile which has just been completed is removed, the traction force for rupturing the band being exerted during the forward motion of the same, by applying the band by one of its surfaces advantageously at the predetermined rupture line, against stationary means, by deviating the band downstream and upstream of its part under application, from its normal path, advantageously in a perpendicular direction with respect to the plane of the band, while guiding the band.

24 Claims, 5 Drawing Sheets

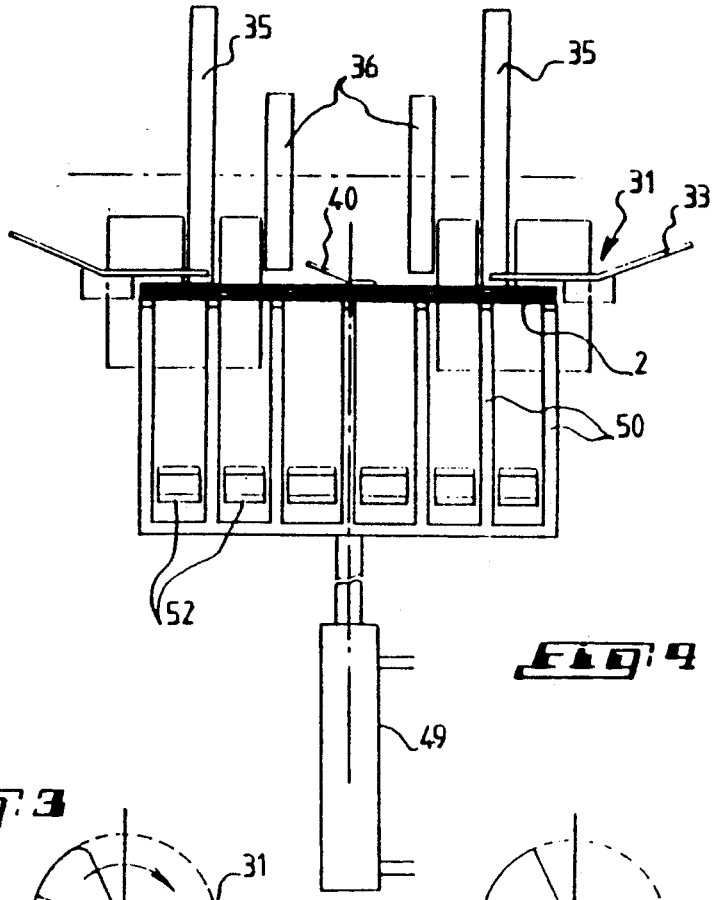
FIG. 4
FIG. 3
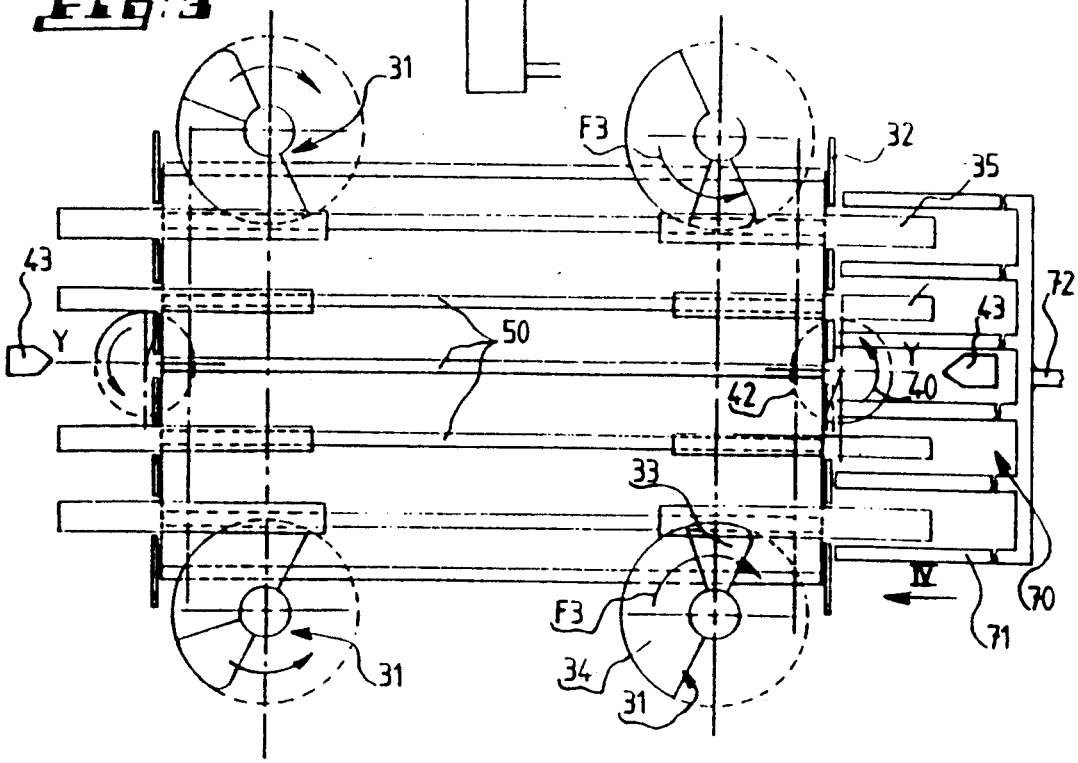

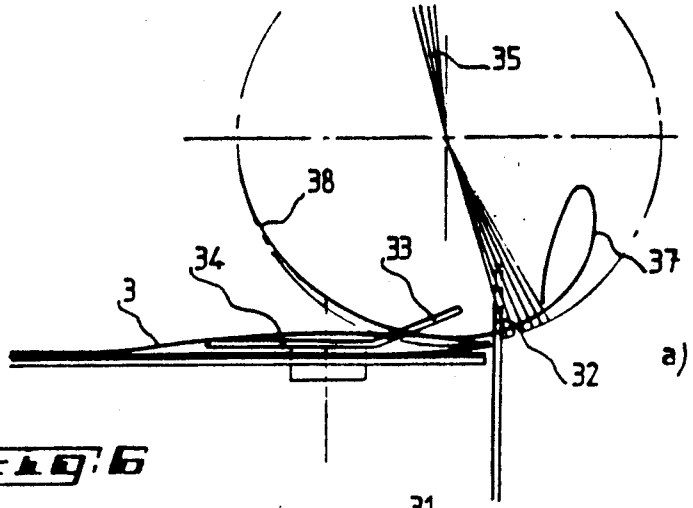
FIG. 6
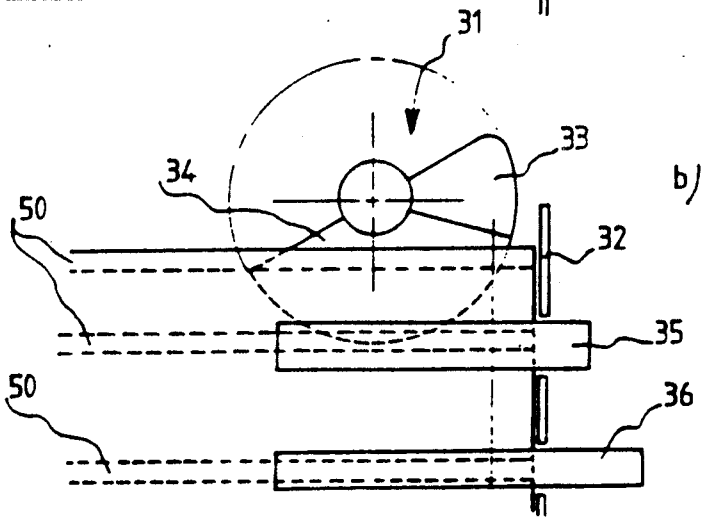
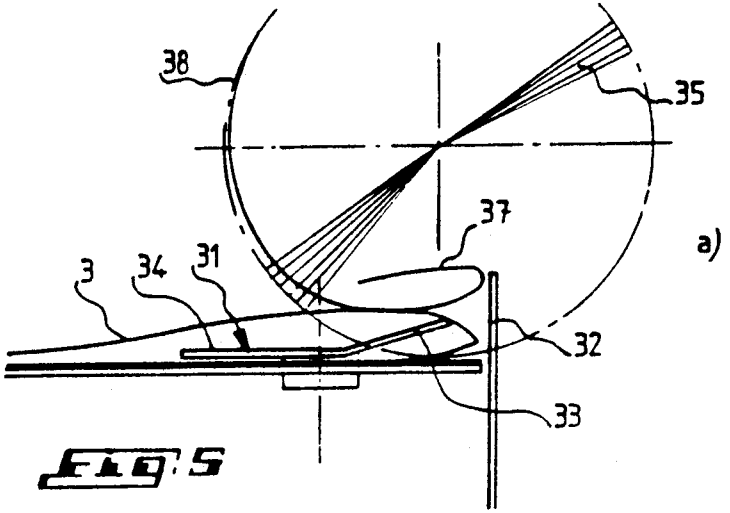
FIG. 5
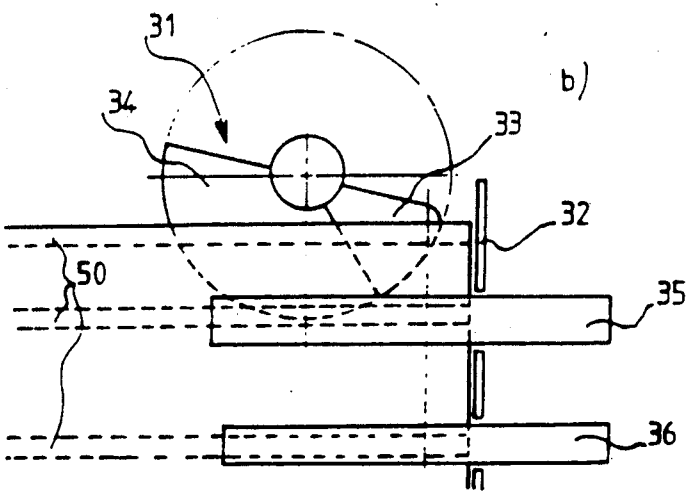

a)
b)
11
61
60
31
33
34
35
32
2
50
36 a)
b)
11
61
31
60
35
34
32
2
50
36 a)
b)
11
61
31
60
35
36
33
32
2
50
36

METHOD OF FORMING ZIGZAG-SHAPED PILES FROM A CONTINUOUS BAND OF A FLEXIBLE MATERIAL AND MACHINE FOR CARRYING OUT THIS METHOD

This application is a continuation of application Ser. No. 07/282,366, filed on Dec. 9, 1988, now abandoned.

The invention relates to a method of forming piles from a continuous band of a flexible material, such as paper, by folding the band, so as to form a zigzag, along pre-established transversal folding lines, such as transversal perforation lines, and to a machine for carrying out this method.

The formation of piles by folding such as to form a zigzag shall be carried out at a relatively high speed, in particular in the case of paper coming from a laser printer where the paper has been printed. It is well known that such printers operate at high speeds. It has appeared that in these conditions, the deposit and especially the retaining of a folding flap on the already formed part of the pile constitutes a difficult problem. A still more difficult operation is the deposit of the last flap of a pile which has just been formed and of the first flap of the following pile.

According to a known method and to the machine for carrying out the same, the deposit of the flaps so as to form a zigzag from an endless band is performed with the aid of a pendulum device which effects a pivoting movement above a supporting table for the pile. This continuous band is cut along the folding line which is in the shape of a weakening line of the material forming the band and connects the last flap of the pile being formed and the first flap of the following pile. In order to perform this operation of separation of the band, this one is stopped when the line of the separation to be performed is just upstream of the pendulum. Then the said last flap is squeezed between two clamping rings and the said first flap is displaced in the direction opposite to that of the forward motion of the band. Under the effect of the traction force thus imposed upon the part of the band which comprises the line of separation, the rupture of the band is provoked. Then the means for feeding the band in its normal direction are started again until the front edge of the said first flap just comes out of the pendulum. Then the pile which has just been completed with the deposit of the last flap is removed. After this process the forward movement of the band is started again for the formation of a new pile.

It is evident that this known method as well as the machine for carrying the same do not constitute a satisfactory solution to the problem which has just been stated. Indeed, the numerous processes which are necessary in order to obtain the separation of the band, and which comprise even a process for the backward actuation of the same, are not compatible with the mode of operation of laser-printers working at high speeds.

The present invention has for a object to provide a method and a machine which do not present the drawbacks of the state of the art which has just been stated.

In order to meet this object, the method according to the invention is characterized in that the traction force for rupturing the band is exerted during the forward motion of the same by applying the band by one of its surfaces, advantageously at the predetermined rupture line, against stationary means, by deviating the band downstream and upstream of its part under application, from its normal path, substantially in a perpendicular direction with respect to the plane of the band, while guiding the band.

According to an advantageous feature of the invention, the forward motion of the band is interrupted and the pile formed is withdrawn, when the front edge of the said first flap lies in the position of the first flap of the new pile to be formed and is retained in this position by means of transitory support.

According to another advantageous feature of the invention, the said means of transitory support belong to the means for folding the band in its exact zigzag configuration.

The machine for carrying out the method of the invention is characterized in that the supporting means intended to provoke the rupture of the band along a predetermined rupture line comprise a device provided with rupture edges disposed so as to come into contact with one of the surfaces of the band and located between two devices for deviating the band from its normal path, each comprising at least one cylinder whose axis is perpendicular to the longitudinal direction of the band and parallel to the plane of the same, on the side of the other surface of the band and is movable in a perpendicular direction with respect to the plane of the same in order to come into contact with this surface for provoking the said deviation of the band while forcibly applying the band against the said device provided with rupture edges, and in that means forming guiding paths for the band at and downstream of the location of the rupture of the band are provided.

According to an advantageous feature of the invention, the pendulum device provided for the formation of the pile in a zigzag configuration comprises elements for moving the band of paper in the feeding direction.

According to another advantageous feature of the invention, the machine comprises a device for transitorily supporting and retaining the first folding flap of a new pile, which comprises four disks which can rotate in synchronism with the movement of the pendulum, in planes parallel to the plane of deposit of the folding flaps for the formation of a pile, each one lying at a corner of the pile to be formed, near a longitudinal edge of the flaps, so as to engage by a part of its surface into the loop formed by a folding flap during its deposit in order to form a pile, and in association with each disk an element which can rotate around an axis which is parallel to the folding lines of the flaps deposited, located above the said surface of deposit and the part of the disk engaging into the said loop, at such a distance from the upper surface of this part that the part forming the front edge of the said first flap can occupy a tight engagement position between the peripheral surface of the said rotary element and the said upper surface of the disk and advantageously that it can come into the position it will occupy in the pile formed, each disk and its associated rotary element rotating in the direction of rotation towards the folds of the deposited flaps, in synchronism with one another.

According to still another advantageous feature of the invention, a said rotary element is formed of a brush whose cross-section perpendicular to its axis of rotation presents advantageously the shape of a segment of a circle.

The invention will be better understood and other objects, features, details and advantages thereof will appear more clearly from the following explanatory description with reference to the appended diagrammatic drawings given by way of example only illustrating an embodiment of the invention and wherein:

FIG. 3 is a view along arrow III—III of FIG. 2, the pile under formation and the lower part of the machine being suppressed;

FIG. 4 is a partial view in the direction of arrow IV of FIG. 2;

Figures 7, 8, 9:
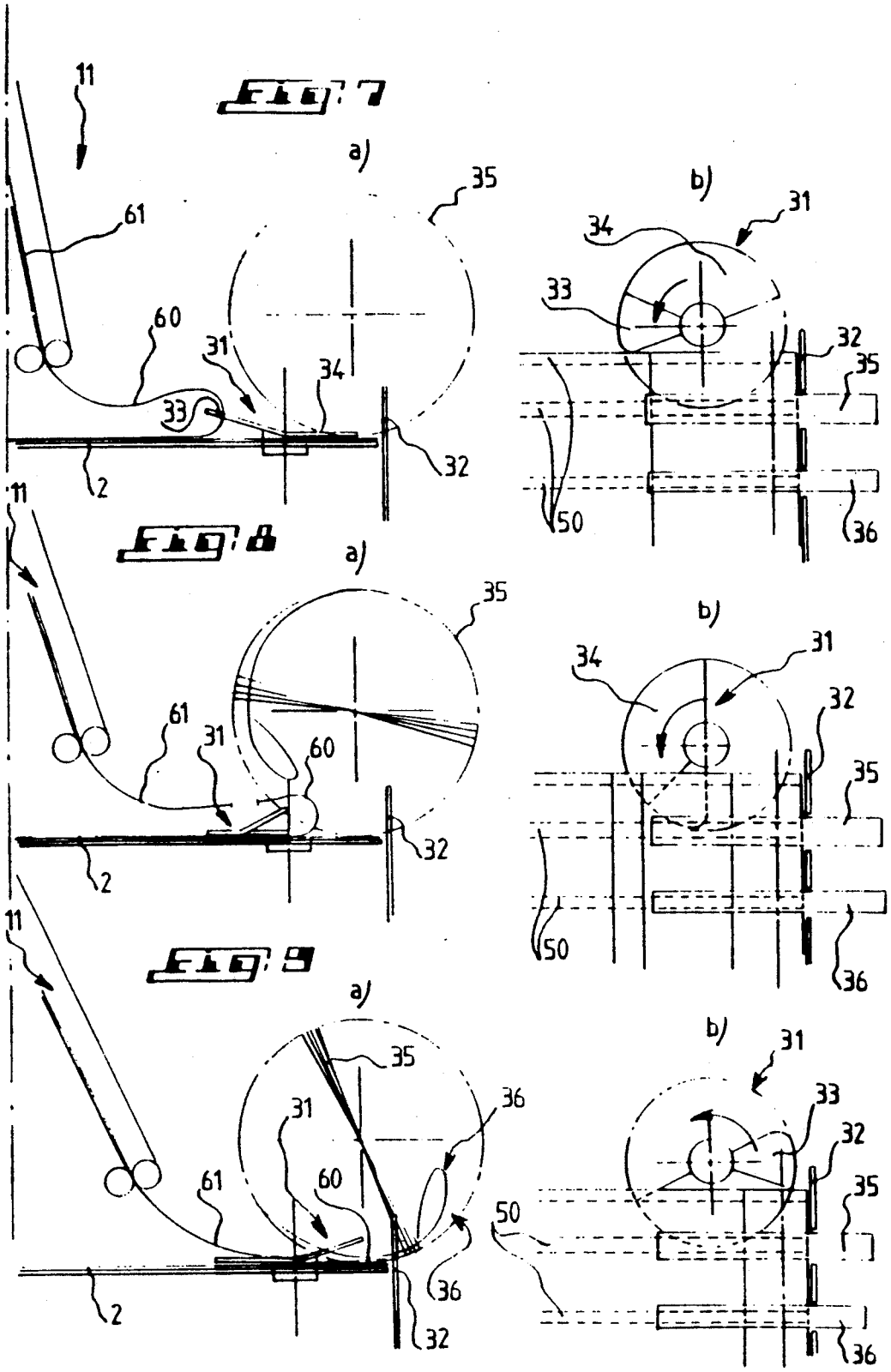

FIGS. 5*a*, 5*b* and 6*a*, 6*b* illustrate two phases of the operation of the machine according to the invention, by respectively side (a) and top (b) views; and FIGS. 7 to 9 show diagrammatically three phases of the method and of the operation of the machine according to the invention, for obtaining the deposit of the last flap of one pile and the feeding and the retaining of the first flap of a new pile, a and b being respectively side and top views.

Figures 2, 10:
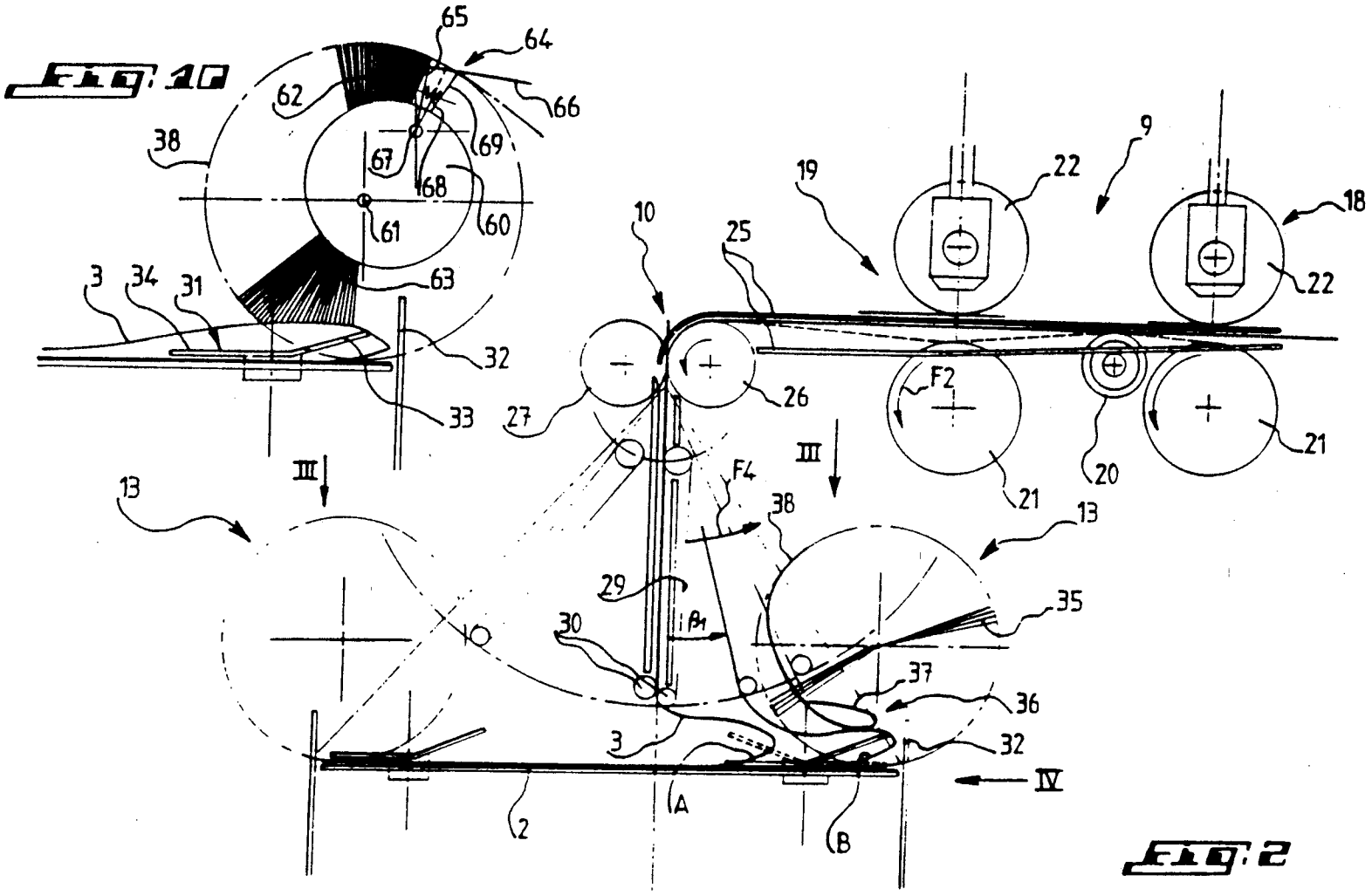
FIG. 2 shows, in a diagrammatic manner, and in an enlarged scale, the part shown at II in FIG. 1.

FIG. 10 illustrates another embodiment of a brush according to FIG. 5*a*.

Figure 1:
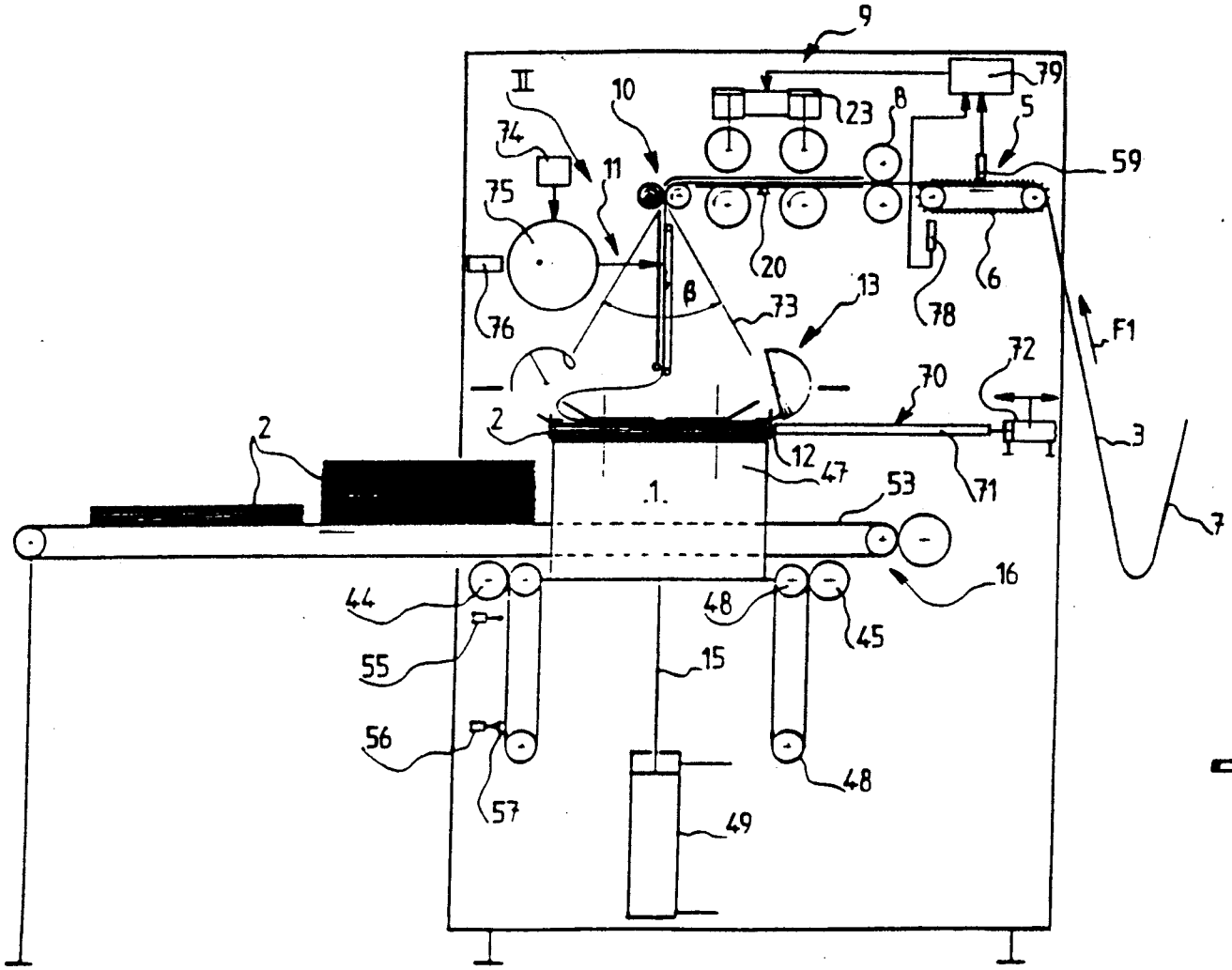
FIG. 1 is a diagrammatic elevational view of a machine according to the present invention.

FIG. 1 shows diagrammatically a machine according to the invention which is adapted to form on a supporting device 1 piles 2 in a zigzag configuration, from an endless band 3 of an appropriate flexible material, in particular paper, which is supplied by a preceding machine not shown, for example a laser-type computer printer. This endless band comprises longitudinal perforations of the type of Caroll holes and transversal weakening lines such as perforation lines which form the folding lines of the band in its zigzag configuration on support 1. The longitudinal and transversal perforations are known per se and are not shown.

According to the embodiment shown, the machine comprises successively in the direction of the forward motion of the band 3, shown by arrow F1, essentially a device 5 comprising two sprocket synchronous belts 6 intended to engage into the Caroll holes of band 3 in order to ensure the motion of the band 3 forming a loop 7 upstream of the device 5, edge-cutting elements 8, an assembly 9 for separating the band intended to perform a rupture of the band along a predetermined rupture line formed by a transversal perforation line, a device 10 for directing the band towards a pendulum device 11 known per se which effects an oscillating movement in an angular zone $\beta$ as a function of the size of the folding flaps delimited between two adjacent weakening and folding lines of the band. This pendulum device has a function to deposit the endless band 3 onto the support 1 according to a zigzag configuration for the formation of a pile. The machine comprises further, at each side edge indicated at 12, an assembly 13 for flattening and for retaining the flaps on a pile being formed and of the first flap of a new pile, as will be described with more detail later. The reference signs 15 and 16 designate respectively means for displacing the supporting device 1 and the means for the removal of a completed pile, of the machine according to the invention.

Referring to FIGS. 2 to 4, the different important devices forming the machine shown in FIG. 1 will be described with more detail.

As shown in FIGS. 1 and 2, the device 9 for separating the band 3 along the rupture line formed by the transversal perforation line connecting the last flap of the pile being formed and the first flap of the new pile, comprises essentially two pairs 18, 19 of cylinders located respectively upstream and downstream of a certain number of members 20 provided with rupture edges and which are juxtaposed directly under the band 3 in the transversal direction with respect to the band. The two cylinders 21, 22 of both pairs of cylinders 18, 19 are located respectively below and above the band, at a predetermined distance, their axes extending in a perpendicular direction with respect to the direction of the forward movement of the band 3, in a direction parallel to the plane of the same when it occupies its normal feeding position indicated in continuous line. Both lower cylinders 21 can rotate around stationary axes and are advantageously rotated by appropriate driving means as indicated by arrows F2. Both upper cylinders 22 can rotate around axes which can move in a direction perpendicular to the plane of band 3, with the aid of appropriate hydraulic cylinders mounted in a common support 23. The cylinders 22 are movable in translation between the shown position remote from the upper surface of band 3 and a position where they deviate the band perpendicularly with respect to its normal position until it comes into tight contact with the peripheral surface of the lower driving cylinders 21. In this position, the band 3 occupies the position shown in dotted lines. Under the effect of the pushing force of cylinders 22, the elements provided with rupture edges 20 provoke the rupture of the band, the lowering of cylinders 22 being provoked when the transversal perforation line forming the reference rupture line lies at elements 20.

It appeared that the cylinder 22 of pair 19 shall be able to slightly slide on cylinder 21 until the transversal perforation line arrives at the rupture device 20. It would be then advantageous to form this cylinder as a brush.

In order to ensure the guiding of band 3 during its normal movement and of the said last and first flaps, after the separation of the band, a device 25 is provided for guiding the band up and down, which extends from a position upstream of the first pair 18 of cylinders to the directing device 10 while widening out in the perpendicular direction with respect to the plane of the band, as shown in FIG. 2. This guiding channel 25 presents recesses in its upper and lower walls which permit the cylinders 21 and 22 to enter the channel. Concerning the directing device 10, it comprises a driving cylinder 26 which extends advantageously on the entire width of the band, as do cylinders 21 and 22 and for example, two or more than two brushes 27 which are axially juxtaposed along the width of band 3, and which are parallel to the axis of cylinders 26 and disposed so as to ensure the application of the band against the peripheral surface of the driving cylinder 26 by coming into tight contact with the other surface of the band.

As shown in FIG. 2, the guiding channel 25 performs the function of a buffer guiding and storing of the band before the band engages between cylinder 26 and brushes 27. The paper band 3 squeezed between cylinder 26 and brushes 27 is introduced into the pendulum assembly 11 comprising essentially flat belts 29 which rotate at the speed of the synchronous belts 6 and guide band 3 between themselves and rollers 30 comprising one driving roller, and located at the free end of the pendulum. Therefore, the band is drawn to the outlet of the pendulum. The pendulum assembly distributes alternately the folding flaps to the flap-flattening and retaining assemblies 13.

Referring in particular to FIG. 3, it is seen that each assembly 13 comprises essentially two disk-shaped elements 31 which can rotate around axes located on both sides of the supporting device 1, in a plane parallel to the plane of deposit of the flaps on this device, near abutment members 32 for the folds of the flaps. Each disk is rotated in the direction of arrow F3 and is made, in the example shown, under the shape of a substantially semi-circular disk whose front part 33 is folded upwards under an angle of 45°, according to a predetermined angle as a function of the size of the folding flaps and is followed by an horizontal part 34. As shown in the figures, the disks 31 are disposed in such a manner that they engage while rotating into the space of deposit of the flaps of the supporting device 1, for the purpose which will be explained in detail later. To each of the disks 31 is associated a rotary element 35 which is advantageously in the shape of a segment of a circle with an angle equal to or somewhat higher than 180° and which is formed of a brush. Each of these brushes 35 is rotated around an axis extending in a parallel direction with respect to the plan of deposit and to the folds of the flaps lying on support 1, at a certain distance and location above the plane of deposit of the flaps and the planes of disks 31 so as to be able, while rotating, to come into contact with the peripheral zone of the flat upper surface 34 of disks 31, when the semi-circle shaped disk engages into the space of deposit of the flaps, as clearly seen from the figures. Owing to this relative arrangement of disks 31 and brushes 35, the first flap of a new pile in zigzag configuration on support 1 can be retained in a defined position, while being squeezed between these elements as will be explained later. Each assembly 13 comprises further two elements 36 referred to as hammers disposed in a symetric relationship with respect to the median line Y—Y of the plane of deposit between the two brushes 35. Each hammer can rotate around an axis which is advantageously the same as the axis of rotation of brushes 35. Each hammer presents a head-forming part 37 and a tail-forming part 38. As appears in particular in FIG. 2, the tail presents a substantially cylindrical peripheral surface whose diameter is substantially equal to the diameter of brushes 35, while the head-forming part 37 is offset in the direction of the axis of rotation of the hammer. The radius of curvature of the head-forming part increases progressively to the tail 38. This arrangement of the hammers permits, while they are rotating, flattening progressively the loops of the band during its deposit in a zigzag configuration on support 1. The hammers are rotated by driving means, at a speed equal to that of the brushes and in synchronism with the forward movement of band 3 and of the oscillating movement of the pendulum device 11. The angular position of hammers 36 with respect to that of brushes 35 and of disk 31 is well defined in order to ensure the cooperation of these various elements, which will be described later.

Each assembly 13 comprises also between the two hammers a measuring helix-forming member 40 which rotates in synchronism with the disks 31 which are also helix-shaped. The front part 41 of helix 40 is folded upwards according to a predetermined angle, on an angular range of for example 90°, this raised part being followed by a horizontal part 42, i.e. whose plan is parallel to the horizontal part 34 of disk 31. The measuring helix 40 is mounted so as to move freely upwards along its axis of rotation. It is disposed so as to engage by a part of its surface into the space of deposit of band 3 in a zigzag configuration, so as to be displaced upwards when the height of a pile being formed on the supporting device 1 increases. To the measuring helix 40 is associated a contact of an electric circuit (not shown) which controls the switching off of a brake 44 and the starting of a back-geared motor 45, belonging to the supporting device 1 (FIG. 1).

The device 1 for supporting the piles comprises essentially a delivery table 47 mounted in a vertically movable manner, under the effect of chain wheels 48 and of a cylinder 49. For the descending motion, table 47 is driven by the chain wheels 48, the cylinder 49 being inactive. This motion stops when helix 40 stops riding on the flaps forming the pile. The descending motion is controlled by cylinder 49. The delivery table 47 presents a comb-shaped structure as clearly seen in FIGS. 3 and 4. Thus, the flaps disposed in zigzag rest on members of vertical wall 50 which are disposed in a parallel relationship with each other while forming between two adjacent members a space which permits the passage of an endless band-shaped conveying means 52. The assembly formed of these juxtaposed conveying members forms an endless conveyor 53 (FIG. 1), for the removal of the completed piles from the machine, as shown in FIG. 1. It is seen that such a wall 50 is located under each brush 35 and each hammer 36 and thus forms a resting surface. In FIG. 1, are represented also at 55 and 56 upper and lower contacts for limiting the travel of the delivery table 47, which cooperate with a projection 57 associated with table 47, more precisely with a chain which goes around wheels 48.

The method according to the present invention will now be described with the aid of the operation of the machine which has just been described:

Referring in particular to FIGS. 2, 5 and 6, the process of depositing the flaps according to a zigzag configuration on the supporting device 1 will be described.

FIG. 2 shows the pendulum device 11 in its substantially vertical position during the deposit of a flap of band 3, while moving in the direction of arrow F4. The band 3 leaving the pendulum 11 forms a loop having the configuration shown diagrammatically at A. At that time approximately, the disks 31 of the flattening and retaining assembly 13, located on the right hand side of the figure, start engaging by their raised front part 33 into the loop. The brushes 35 and the hammers 36 which are actuated there in synchronism with the rotational movement of disks 31 occupy an angular position where they are not yet in contact with the loop. When the pendulum occupies the angular position $\beta 1$, the band forms the loop designated at B. The relative position of disks 31, brushes 35 and hammers 36 is shown in FIGS. 2 and 3. It is seen that the raised front part 33 of the disks is leaving the loop and that the horizontal part 34 of these disks is engaged on the last flap which has already been deposited. The hammers 36 occupy an angular position where the head 37 just begins flattening the ogive-shaped loop B. The brushes are not yet in the position of contacting the loop. FIGS. 5 and 6 show two further phases illustrating the progressive flattening of the loop by the hammers, first by their head 37 and then by their tail-forming part 38, as well as by the action of brushes 35 which push the band 3 on the top part of the semi-disks 31 whose raised front part 33 is leaving the loop formed by the band 3. Finally, when the horizontal part 34 of the disks is also leaving the loop, which is now practically flattened, the folding is completed and the hammers 36 maintain by their tail 38 the two flaps whose fold has just been formed and which are pushed against one another and against the pile being formed. It is to be noted that the cheek-shaped stops 32 stop the movement of the flaps while permitting the passage of brushes 35 and hammers 36 through appropriate windows. It is also to be noted that the disks, the brushes and the hammers of the flattening and retaining assembly 13, which are located on the left hand side of FIGS. 1 and 3 have a phase-shift of 180° with respect to the disks, brushes and hammers of the assembly which has just been described and which flatten the loop which will be formed later by the pendulum 11 on the left hand side of the figures.

During this process of forming the pile, the measuring helices 40 rotate in synchronism with the semi-disks 31. The helices are freely movable upwards along their axis of rotation under the effect of the increase of the number of flaps deposited on the delivery table 47. They can pass on the pile of deposited flaps owing to their raised part 41. Beyond a defined height, the corresponding helix provokes through the medium of an electric contact the switching off of brake 44 and the starting of the back-geared motor 45. Then the delivery table 47 moves downwards by being actuated by chain wheels 48. The movement stops when the helix stops passing on the piles of deposited flaps.

The end of the formation of a pile, the removal of the same from the machine and the preparation of the formation of a new pile will be described with reference in particular to FIGS. 2 and 7 to 9. When a detector cell shown at 59 in FIG. 1, at the device 5 with synchronous belts reads a code present on band 3, it performs the time-programming of the cylinders 23 of device 9 for separating the band, which lower the rubber-coated upper cylinders 22 when the perpendicular rupture performation line lies between the two pairs of cylinders 18 and 19 of device 9, but preferably before the separating rollers 20. The cylinder 21 of pair 18 rotates at the speed of belts 6 whereas the cylinder 21 of pair 19 rotates advantageously slightly faster when the transversal perforation line passes on rupture elements 20. This provokes the rupture of the band. The two cylinders 23 of device 9 provoke then the ascending motion of cylinders 22.

The end of the band, i.e. the last flap of the pile being formed and the first flap of the new pile to be formed are maintained between the guides of device 25. The cylinder 26 and the brushes 27 maintain the separated band at the speed of belts 6. The pendulum assembly 11 with its belts 29 and the rollers 30 pushes the last flap of the band designated by the references sign 60 in FIG. 7*a* towards the corresponding semi-disks 31. It is seen that the first flap of the pile to be formed has the reference number 61. The gap between the two flaps 60 and 61 is very narrow. As seen in FIGS. 7 to 9, which show three successive phases of the final process of forming a pile, the hammers 36 ensure the deposit and the flattening of the last flap 60 on the pile, while the first flap 61 passes above the semi-disks 31 and is applied by brushes 35 on the upper surface of these disks. While being squeezed between the disk and the brushes, the flap is drawn towards the abutment cheeks 32. When the band exceeds a predetermined width, air jet nozzles 43 are operated.

It is at this time that the order is given to start the cycle of removal of the pile, by stopping belts 6, cylinders 21, 26, brushes 27, pendulum 11 with its belts 29 and the rollers 30, semi-disks 31, brushes 35, hammers 36 and helices 40. The brake 44 is released and the cylinder 49 provokes the descending motion of delivery table 47. As this table is in the shape of a comb, it passes through the belts of conveyor 53. The closing of the contact members 27 and 57 stops the descending motion of the table and provokes the switching on of the motor 54 which actuates the bands 52 of removal conveyor 53 in order that it removes the completed pile or parcel as shown in FIG. 1. When the removal of the pile is completed, the cylinder 49 provokes the rapid ascending motion of delivery table 47 until the projection 57 switches on the contact 56, which provokes the end of the ascending motion of the table, the tightening of brake 44 and the re-engagement of the actuating devices of band 3 in order that the pendulum 11 and the assemblies for flattening and retaining 13 can form the new pile.

Numerous modifications and improvements can be brought to the invention without departing from the scope thereof.

Thus, FIG. 10 presents means permitting crushing the folds of the flaps of the piles, so as to avoid an excessive thickness of the piles at the folds with respect to the centre. This effect is obtained by an appropriate conformation of brushes 35. As shown in the figures, such an improved brush comprises a hub 60 which is excentric with respect to the axis of rotation 61 of the brush so that the length of the bristles shown at 63 changes on the periphery of the hub in the manner shown. The length of the bristles increases in the direction opposite to the direction of rotation of the brush. Furthermore, the set of brushes presents a front part 63 in which the length of the bristles decreases progressively with respect to the diameter of the brush in the direction of rotation of the same. Owing to this front part 63, the brush 38 presents a shape which makes it possible for the brush to come into contact with the loop of band 3 in a smooth manner without any risk of formation of an incipient fold at another location than the transversal perforation line separating two adjacent flaps.

Downstream of the set of bristles 62, the hub 60 carries a hammer-forming device 64 for crushing the folds. This device comprises a supporting arm 65 for an oblong shaped hammer-forming member 66. The supporting arm is mounted at the periphery of hub 60, and pivots about an axis 67 substantially parallel to the axis 61 of the brush, against a compression spring 68 oriented substantially in the direction of the periphery of the brush and resting on a member 69 solid with hub 60. The member 69 is located downstream of the supporting arm 65, with respect to the direction of rotation of the brush. The hammer-forming element 66 présents an angle of for example 120° with respect to the supporting arm 65 and is oriented in the direction opposite to the direction of rotation of the brush. In these conditions, the hammer-forming element exerts a pressure on the folding zone which has already been flattened by the set of bristles of the brush and ensures the crushing of this zone under the effect of spring 68 which is then compressed. It is readily understood that in this case the hammers 36 could be suppressed.

It would be also possible to equip the machine according to the invention with an auxiliary supporting device 70 for a new pile of flaps, during the removal of the pile which has just been formed through the rapid lowering of support 1 under the effect of cylinder 49.

The additional supporting device 70 comprises a certain number of horizontal parallel rods 71 which are disposed so as to form a comb-shaped configuration which can be horizontally moved by a double acting cylinder 72, as shown by the arrows. The rods 71 are shifted laterally with respect to the vertical walls 50 of the delivery table 47 of support 1 so that they can replace these walls during the lowering of the table. Once the completed pile removed, table 1 is raised again and the auxiliary support formed by the comb-shaped configuration of rods 71 is removed by cylinder 72 without hindering the already started formation of the new pile.

Consequently, the provision of the auxiliary support 70 in the machine permits removing the completed piles and forming new piles without the need for stopping the machine.

Besides, the machine can be equipped with means which permit that the pendulum 11 stops always at the same extreme angular position, such as for example the position shown at 73 in FIG. 1. In order to obtain this result, an additional motor 74 for actuating an eccentric 75 for controlling the pendulum 11 is provided, one turn of which corresponding to the length of two flaps. To the eccentric 75 is associated a synchronizing finger 76. Owing to these measures, it is possible, once the stopping of the band started, to always bring the pendulum 11 into its predetermined stopping position, which permits obtaining piles where the information printed on the upper flap lies always on the visible face thereof.

To make sure that the separation of the band for the formation of a new pile occurs always in a precise manner, whatever the speed of forward motion of the band may be, the machine comprises further, as shown in FIG. 1, a means 78 for detecting the speed of forward motion of band 3 by counting the teeth of sprockets 6 and a microprocessor 79 which calculates from the values and signals received from the cell 59 detecting the separation code present on band 3, as shown above, and from detector 78, the instant at which the detected rupture perforation line will arrive into its rupture position at the separation rollers 20. Then the microprocessor 72 drives accordingly the cylinders 23 of the device 9 for separating the band. Indeed, as the speed of forward motion of the band is known at every time and as the duration of movement of the cylinders is constant, whatever the speed of the band may be, the actuation of the cylinders can be decided as a function of the speed of the band. For this purpose, the numbers of the tooth at which the cylinders 23 shall be actuated, according to the linear speed of the band, have been stored. Thus, in the starting and stopping steps, the drivings of the functions remain synchronized. This holds true for all the drivings such for example as the driving of the air jet device 43 and of the stopping movement of pendulum 11 during a transfer. This method permits ensuring the separation of the band whatever the size of the flaps may be, without the need to mechanically modify the distance between the separation cylinders, or to stop the machine.

What is claimed is:

1. A method for forming piles from a continuous band of a flexible material comprising the steps of:

providing the continuous band with transverse folding lines such that a folding flap is defined between adjacent folding lines;

conveying the continuous band in a forward direction along a path that is in the vicinity of a stationary rupture device;

folding the continuous band along said transverse folding lines and depositing the folded flaps on a support and a pile forming station that is downstream from said path such that said folding flaps are arranged in a zigzag configuration and stacked in the form of a pile;

rupturing the continuous band at a predetermined folding line between two flaps, the downward flap being designed to become the last flap of a pile that is about to be formed and the upward flap being designed to become the first flap of a new pile to be formed;

determining the instant of time when said predetermined rupture folding line arrives in a zone substantially in front of said rupture device;

deviating the continuous band with said rupture folding line being in said zone in front of said rupture device, in a direction substantially perpendicular to said path at a location near to said rupture device such that the region of the continuous band encompassing said predetermined rupture folding line is forced against said rupture device and subjected to traction forces that rupture said continuous band along said predetermined folding line, thereby separating said first and last flaps, without stopping the forward motion of the continuous band;

maintaining said first and last flaps in close proximity to one another as said separate band continues forward towards a pile forming station;

depositing said last flap on said pile being formed to form a complete pile and removing said complete pile from said pile forming station; and positioning said first flap for forming said new pile.

2. A method according to claim 1, wherein the forward movement of the band is stopped and the pile formed is withdrawn, when the front edge of the first flap lies in its position of the first flap of the new pile to be formed and is retained in this position by transitory support means.

3. The method according to claim 1, wherein the continuous band is deviated in a direction substantially perpendicular to said path at a location upstream and a location downstream of said rupture device when said predetermined rupture folding line arrives between said upstream and downstream locations.

4. An apparatus for forming piles from a continuous band of a flexible material containing flaps defined by transverse folding lines, comprising:

a pendulum assembly adapted for depositing the continuous band on a supporting device in a zigzag configuration of superposed folding flaps and folded along said folding lines;

means for separating the continuous band along any of said folding lines, located upstream of said pendulum assembly;

said separating means comprising a band rupture device provided with rupture edges mounted near to one surface of the continuous band and a band deviating device located on the side of the continuous band that is opposite to the side where the rupture device is located, at a predetermined distance from said rupture device in said band travel path, said deviating device comprising a band deviating rotatable cylinder having an axis perpendicular to the longitudinal direction of the band that is movably mounted perpendicular to said band travel path in a support structure between a first position distant from the continuous band and a second position in contact with the adjacent surface of the continuous band wherein the continuous band is deviated from its travel path and applied against said rupture device, thereby causing the continuous band to separate the continuous band;

means for controlling the motion of said deviating cylinder;

means for detecting predetermined folding lines coded to constitute rupture lines, said detecting means being positioned at a location upstream of said band separator means;

means for calculating a time interval necessary for said coded folding line to move from said detector means to a location in a zone in front of said rupture device and for producing at the end of said time interval a control signal;

means for applying said control signal to said deviating cylinder motion control means to cause said deviating cylinder to move to said second position;

means for guiding said separated band downstream of said separating device to said pendulum assembly.

5. The apparatus according to claim 4, wherein said deviating cylinder is provided at a location upstream of said rupture device and a second deviating cylinder is provided at a location downstream of said rupture device, said deviating cylinders being simultaneously actioned upon the production of said control signal.

6. A machine according to claim 5, wherein to each deviating cylinder is associated one driving counter-cylinder located on the other side of the band, the band being squeezed between these two cylinders in its deviated position.

7. The apparatus according to claim 6, wherein a said counter-cylinder is located with respect to the normal band travel path such that its peripheral surface is at a distance from the travel path that is greater than the distance of the rupture device therefrom.

8. A machine according to claim 5, wherein the separating device comprises a plurality of axially juxtaposed rollers perpendicularly to the longitudinal axis of the band, each roller presenting at its periphery a circumferential rupturing edge.

9. A machine according to claim 5, wherein the pendulum assembly provided for the formation of a pile in a zigzag configuration comprises elements for guiding and moving the band in its feeding direction, comprising advantageously driving belts and rollers located at the free end of the pendulum device and of which one is a driving roller.

10. A machine according to claim 5 comprising a device forming both a device for folding the flaps of a pile being formed and a device for transitorily supporting and retaining the first folding flap of a new pile, which comprises four disks which can rotate in synchronism with the movement of the pendulum, in planes parallel to the plane of deposit of the folding flaps for the formation of a pile, each one lying at a corner of the pile to be formed, near a longitudinal edge of the flaps, so as to engage by a part of its surface into the loop formed by a folding flap during its deposit for the formation of a pile, and, in association with each disk, an element which can rotate about an axis which is parallel to the folding lines of the flaps deposited, located above the plane of deposit and the part of the disk engaging into the said loop, at such a distance form the upper surface of this part that the part forming the front edge of the said first flap can occupy a tight engagement position between the peripheral surface of the said rotary element and the said upper surface of the disk and advantageously that it can come into the position it will occupy in the pile formed, each disk and its associated rotary element rotating in the direction of rotation towards the folds of the deposited flaps, in synchronism with one another.

11. A machine according to claim 10, wherein one aforesaid rotary element is formed of a brush whose cross-section perpendicular to its axis of rotation presents advantageously the shape of a segment of a circle.

12. A machine according to claim 10, wherein said disk has the shape of a segment of a circle, advantageously of 180°, whose front part is raised according to a predetermined angle.

13. A machine according to claim 10, wherein to each aforesaid supporting and retaining device is associated at least one hammer for flattening the zones of folding of two successive flaps to be deposited, which can rotate in synchronism with the aforesaid disks, around an axis parallel to the folding lines above the plane of deposit and presents a circumferential surface of contact with the folding zone to be flattened under the shape of a cam comprising a head-forming front part shifted towards the axis of rotation like a portion of a spiral and a tail-forming cylindrical part, the axis of the flattening element being disposed above the plane of deposit at a distance substantially equal to the diameter of the tail-forming part.

14. A machine according to claim 13, wherein two flattening hammers are associated to each aforesaid supporting and retaining device, located symmetrically on both sides of the longitudinal median line of the plane for depositing the flaps, of the device for supporting the piles.

15. A machine according to claim 9, comprising on each lateral side of the plane for depositing the flaps, substantially in the middle, an element for measuring the height of the pile and for driving the lowering of the device for supporting the pile, in the shape of an helix rotating in synchronism with the aforesaid disks, around a substantially vertical axis, which is freely movable upwards along its axis and disposed so as to rest on the zone of the upper fold.

16. A machine according to claim 13, wherein the supporting device comprises a delivery table with a vertical cross-section in the shape of a comb and comprising a plurality of juxtaposed parallel vertical walls, extending in the longitudinal direction of the supporting device, whose front horizontal surfaces form the surface for supporting the piles and which are located in such a manner that a wall lies below each rotary element in the shape of a brush and of flattening hammers.

17. A machine according to claim 11, wherein the brush presents the general shape of a segment of a circle having an angle equal to or somewhat higher than 180°.

18. A machine according to claim 17, wherein the brush comprises an eccentric hub for supporting a set of bristles disposed in such a manner that the length of the bristles decreases around the periphery of the hub in the direction opposite to the direction of rotation of the brush, this set presents in its front part a zone where the length of the bristles decreases in the direction of rotation of the brush in such a manner that the set comes into contact with a loop of the band to be deposited, in a smooth and progressive manner, and the hub carries, downstream of the set, a device for crushing the folds of the flaps, which comprises a hammer-forming element capable of exerting a crushing pressure on the folds, under the effect of a spring.

19. A machine according to claim 16, comprising an additional supporting device having the shape of a comb which is horizontally movable so as to replace transitorily the delivery table during the removal of a completed pile.

20. A machine according to claim 5 comprising means for stopping the pendulum in a predetermined angular position whatever the instant of stopping of the machine may be.

21. A machine according to claim 5 comprising a means for detecting the speed of forward motion of the band, a means for detecting a separation code on the band and a calculating device such as a microprocessor adapted for calculating the instant of driving the devices for deviating the band from data received on the basis of the detectors.

22. The method according to claim 1, wherein the withdrawal of a completed pile from the pile forming station and the forming of a new pile are effectuated simultaneously without stopping the forward motion of the band.

23. The method of claim 1 wherein said transverse folding lines are perforated.

24. The method of claim 1 wherein said flexible material is paper.

* * * * *